United States Patent [19]

Prochnow et al.

[11] Patent Number: 4,797,985

[45] Date of Patent: Jan. 17, 1989

[54] METHOD OF APPLYING A METALLIC GUIDE BAND TO A THIN-WALLED PROJECTILE BODY

[75] Inventors: Jürgen Prochnow; Jörg Peters, both of Düsseldorf; Ulrich Theis, Mülheim; Klaus D. Karius, Jüchen, all of Fed. Rep. of Germany

[73] Assignee: Rheinmetall GmbH, Düsseldorf, Fed. Rep. of Germany

[21] Appl. No.: 927,556

[22] Filed: Nov. 6, 1986

[30] Foreign Application Priority Data

Nov. 6, 1985 [DE] Fed. Rep. of Germany ..... 35310

[51] Int. Cl.[4] ..... B21K 21/06

[52] U.S. Cl. ..... 29/1.21; 29/1.23; 29/527.2; 29/90.7; 102/524

[58] Field of Search ..... 29/1.2, 1.21, 1.22, 29/1.23, 90 R, 90 A, 527.2, DIG. 13, DIG. 14; 51/319, 320, 321; 102/524–528

[56] References Cited

U.S. PATENT DOCUMENTS

| | | | |
|---|---|---|---|
| 390,242 | 5/1943 | Long | 102/526 |
| 469,631 | 2/1892 | Driggs | 102/526 |
| 2,353,693 | 7/1944 | Church | 29/1.2 |
| 2,360,473 | 10/1944 | Calkins | 102/526 X |
| 2,440,952 | 5/1948 | Hurley | 29/1.2 X |
| 2,841,687 | 7/1958 | Richter | 102/524 X |
| 4,660,263 | 4/1987 | Kosteck | 29/1.73 |

FOREIGN PATENT DOCUMENTS

| | | | |
|---|---|---|---|
| 831595 | 5/1981 | U.S.S.R. | 51/426 |

*Primary Examiner*—Timothy V. Eley
*Attorney, Agent, or Firm*—Spencer & Frank

[57] ABSTRACT

A method of applying a metallic guide band to the body of a projectile having particularly thin walls comprises making fine particles plastically deformable by heating thereof, and spraying said heated particles at high speed onto a surface section of the projectile body until a desired layer thickness of the guide band is attained. A projectile body having a circumferential guide band is produced by the method of the invention. The thin-walled projectile body has a boundary layer region on its exterior which may be roughened and/or deoxidized. The boundary layer region is formed by an intermediate layer which may be composed of molybdenum, nickel aluminide or nickel oxide and itself has a roughened boundary layer region on its exterior. This results in a particularly intimate physical bond with the particles of alloy of the guide band. The alloy is preferably of a CuZn85/15 type and has a porosity of up to 5 volume percent.

22 Claims, 1 Drawing Sheet

METHOD OF APPLYING A METALLIC GUIDE BAND TO A THIN-WALLED PROJECTILE BODY

BACKGROUND OF THE INVENTION

1. Field of the Invention

The present invention relates to a method of applying a metallic guide band to the body of a projectile and also relates to the banded projectile body proper.

2. Description of the Background

One or more circumferential guide bands are provided in the tail region of artillery projectiles. These guide bands are metal rings which rest in corresponding annular grooves on the surface of the projectile body. The thickness of a guide band is greater than the depth of the associated annular groove so that the guide band projects outwardly out of the surface of the projectile body.

For firing, the projectile is pressed into a gun barrel provided with so-called rifling and lands. The guide bands are deformed in a manner corresponding to the shape of the rifling and lands in order to reliably perform their guide function during firing of the projectile.

Consequently, the guide bands must have a certain ductility and sufficient stability to transfer the optimum spin to the projectile during its ejection. This also requires a reliable connection with the projectile body since considerable transverse forces act on the projectile body during use. This steady connection is attained by pressing the guide bands into the corresponding annular grooves in which they are firmly seated.

The configuration of the above-described annular groove has the drawback of mechanically weakening the corresponding part of the projectile body. This drawback becomes the more noticeable, the thinner the wall of the projectile is. This results in corresponding limitations.

Thus, for the most part, present-day projectile bodies must still have a thickness of more than ten millimeters.

SUMMARY OF THE INVENTION

It is an object of the invention to provide a projectile body having a circumferential guide band in which the above-described losses of stability are minimized without relinquishing an absolutely reliable connection between body and guide band.

These and other objects of the invention are attained by providing a method for applying a metallic guide band to a projectile body, comprising making fine particles plastically deformable by heating thereof; and spraying the heated particles at high speed onto a surface section of the projectile body until a desired thickness of the guide band is attained.

The objects of the invention are also attained by providing a projectile body having a circumferential guide band obtained by the above method.

A more complete appreciation of the invention and many of the attendant advantages thereof will be readily perceived as the same becomes better understood by reference to the following detailed description of the accompanying figures.

DESCRIPTION OF THE PREFERRED EMBODIMENTS WITH REFERENCE TO THE DRAWINGS

The invention provides a projectile body having a circumferential guide band in which the prior art loss of stability is minimized without relinquishing an absolutely reliable connection between the body and the guide band.

The invention is based on the discovery that it is unnecessary to provide an annular groove on the surface of the projectile body into which the guide band is pressed.

Instead, a method is provided for reliably applying the guide band directly to the closed surface of the projectile body so that the selection of the thickness of the projectile body required to attain minimum strength is no longer a function of the guide band but is determined exclusively by the characteristics of the materials and compounds employed for the projectile body itself.

Figure 1:
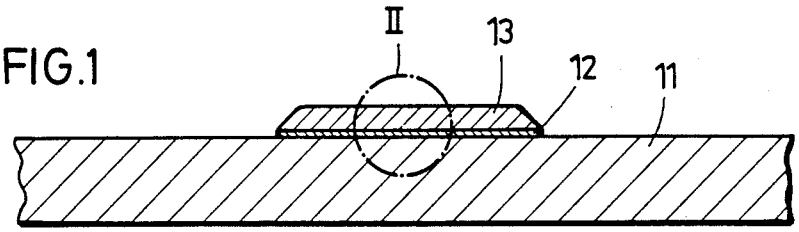
FIG. 1 is a longitudinal, cross-sectional detail view of one side of a thin-walled projectile body including a thin-walled projectile body and a guide band according to the invention.
Figure 2:
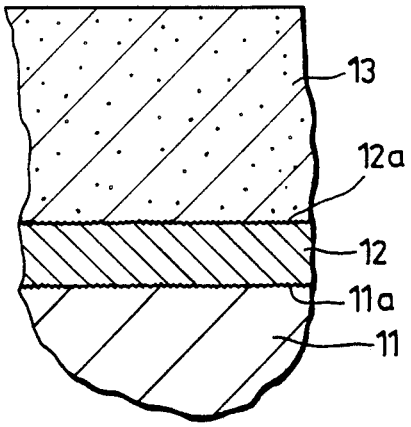
FIG. 2 is an enlarged cross-sectional detail view of approximately region II of FIG. 1.

FIG. 1 shows the thin wall 11 of the projectile body, an intermediate layer 12 and an alloy 13 of the guide band. The details of the structure are clarified in FIG. 2. The material 11 of the wall of the projectile body has a boundary layer region 11a which has been roughened and deoxidized on the exterior. The boundary region 11a is followed by an intermediate layer 12 composed of molybdenum, nickel aluminide or nickel oxide and itself has a roughened outer boundary layer region 12*a*. This produces a particularly intimate physical bond with the particles of alloy 13 of the guide band. The alloy is preferably represented by a CuZn85/15 type which has a porosity of about 5 volume percent.

Thus, the present invention offers a way of providing a projectile body made with known materials but having a thinner wall since no annular grooves which would reduce the cross-section and strength of the projectile are required.

The method of the invention for applying a metallic guide band is thus directed particularly to projectile bodies which are thinner than those of the prior art. However, it could be applied to projectile bodies having a wall thickness such as that utilized by the prior art as well.

The invention provides a method for applying a metallic guide band to a projectile body, comprising making fine particles plastically deformable by heating thereof, and spraying the heated particles at high speed onto a surface section of the projectile body until a desired thickness of the guide band is attained. Thus, the guide band is applied directly to the surface of the projectile body. According to the invention, the band is no longer applied in the form of a pre-shaped metal band but is gradually formed by spraying fine deformable metal particles onto the projectile. The particle size can be custom taylored as a function of, inter alia, the temperature, the spraying velocity, the thermal conductivity of the material and its melting point, but will generally lie in the μm range.

Thus, it is important to propel particles of the most suitable size in a heated state onto the body surface so that the plastically deformable regions of the particles are able to deform upon impact and form a totally compact structure.

It is important to prevent overheating of the surface of the projectile body which brings about undesirable changes in the structure thereof. An advantageous feature of the invention addresses this problem by providing for the heating of the particles only to a temperature range within which only their surface regions begin to melt. This so-called surface plastification is sufficient to deform the particles when they impinge on the projectile body or to deform the particles that had previously impinged on the surface and to thus gradually build up a dense pack of particles. This gradually results in the desired guide band, preferably applied by rotating the projectile body with a stationary spraying device.

Such methods are know in other fields e.g., for the repair of damaged silos, etc., by the name of "flame spraying" or "electric arc spraying". However, the use of the principle of these methods for the application of a guide band to a projectile body constitutes a novel use. These methods have not been used in the past in the field of armaments, and more specifically they have not been used in the production of artillery shells.

All prior art modifications which provide, e.g., the replacement of metallic guide bands with plastic guide bands, also propose the formation of an annular groove on the surface of the projectile body (U.S. Pat. No. 3,910,194).

Thus, it is surprising that it is possible to form guide bands by spraying plasticized metal particles. It is also surprising that these guide bands exhibit sufficient adhesion to the projectile body and have the necessary deformability to be able to be pressed into the rifling of the gun barrel.

Generally, projectile bodies are made of high strength steel, e.g., an alloy of the 30 CrNiMb8 type, while the material for the guide bands is preferably a copper-zinc alloy. However, since it is difficult to bond copper to iron an advantageous feature of the invention provides for the application to the surface of the projectile body of an adhesive layer, preferably by spraying prior to spraying of the particles to form the guide band.

This is particularly the case for projectile bodies which are coated with an oxide skin. Thus, it may be advantageous to initially activate this oxide skin, i.e., remove the oxide skin and roughen the surface in order to provide a greater surface for attack and bonding of the adhesive layer.

The material for the adhesive layer may be molybdenum, nickel aluminide or cermets based on aluminum nickel oxide. Since a molybdenum-sprayed bonding layer has relatively low tensile strength, nickel aluminide (80 weight % nickel, 20 weight % aluminum) is generally preferred. It has a tensile strength that is about twice as high as that of a molybdenum layer. However, other materials may also be used which can be selected as especially suited for use with the materials of the projectile body and the guide band.

The invention provides still another advantageous feature in the form of a pretreatment of the projectile body surface before the application of the adhesive. This is the use of corundum or chill cast gravel in the finest grain sizes as a blasting medium.

The heating of the metal particles being sprayed to form the guide band can be effected electrically as well as with a gas flame, preferably with an acetylene/oxygen gas mixture. If necessary, a protective gas can be mixed in to minimize oxidation. The present invention also provides for effecting the entire process in a closed chamber in which a protective gas atmosphere, e.g., of an inert gas such as argon, is maintained. However, other inert gases may also be used.

In contrast to flame spraying, the melting output attainable by spraying with an electric arc does not have a theoretical upper limit. It increases almost linearly with the current intensity furnished by a current source. However, limitations in peak output do result in that a certain quantity is to be applied only within a certain time interval. In addition, overheating of the sprayed layer and thus of the surface of the projectile body is to be avoided since it leads to losses in strength.

In a further advantageous feature, the present invention proposes to avoid overheating by cooling the projectile body from the inside during the spraying step.

By spraying in accordance to the invention, a more or less dense layer is applied, particularly as a function of particle size, temperature and kinetic energy with which the particles impinge on the surface. This layer can be varied almost at will by modifying the above-mentioned parameters. Thus, it is possible to set different strength/ductility values and/or porosities for the guide band(s) as well as to select the material for the projectile body. It has been found that porosities of up to 5% are of advantage since this favorably influences deformability.

However, the above-mentioned process parameters also have an influence on the degree of deformation imparted to the surface of the projectile body by the sprayed-on-particles. In this connection, an advantageous feature of the invention provides that when the thickness of the material of the projectile body is only about 2 mm to 4 mm, the deformed region of the projectile body is less than 0.1 mm. This layer then forms a sort of diffusion layer between the projectile body and the adhesive/binder layer. The above example shows that the thickness of the projectile body according to the invention is noticeably reduced when compared to conventional body thicknesses for the same projectile body strength. Thus, the useful area of the projectile can be enlarged considerably for the same caliber. This is another significant advantage of the body according to the present invention.

There are further advantageous features of the invention, e.g., the heating may be conducted electrically instead of heating the solid particles with a gas flame. Other materials may of course also be used in addition to the already described materials for the projectile body and the guide band. Although the projectile body is preferably made of high-grade steel alloys have been found to be particularly advantageous as materials for the guide band when compared to physical mixtures of substances.

One other feature of the invention provides that a template provided with a recess corresponding to the width of the guide band is placed onto the body during spraying for faster and more direct working. Thus, the region to be covered can be better limited. If necessary, the applied guide band once produced as described above can additionally be machined to give it a defined shape.

The invention now being fully described, it will be apparent to one of ordinary skill in the art that many changes and modifications can be made thereto without departing from the spirit or scope of the invention as set forth herein.

The present disclosure relates to the subject matter disclosed in German Patent No. P 35 39 310.6 filed November 6th, 1985, the entire specification of which is incorporated herein by reference.

We claim:

1. A method of applying a metallic guide band to a thin-walled projectile body of refined steel comprising the following steps:

(a) roughening a circumferential ungrooved surface portion of the projectile body by blasting said surface portion with a fine-grained material of greater hardness than the material of the projectile body;

(b) subsequent to the roughening step, applying a bonding layer of preheated fine solid particles to the ungrooved roughened surface portion;

(c) heating fine metal particles at a temperature effective to obtain solely a surface plastification of the fine metal particles; and (d) subsequent to the step of applying the bonding layer, spraying the heated fine metal particles onto said bonding layer to form said guide band, bonded to said projectile body by said bonding layer.

2. The method of claim 1, wherein the heating step comprises the step of heating with a gas flame.

3. The method of claim 2, wherein the gas flame is obtained with a gas selected from the group consisting of acetylene/oxygen and hydrogen/oxygen mixtures.

4. The method of claim 1, wherein the heating step comprises the step of heating electrically.

5. The method of claim 1, wherein the spraying step comprises the step of spraying the particles onto the projectile body surface in a protective gas atmosphere.

6. The method of claim 1, further comprising deoxidizing the surface section of the projectile body to be covered by said heated particles prior to applying the binder layer.

7. The method of claim 1, wherein said fine-grained material is selected from the group consisting of corundum and chill cast gravel.

8. The method of claim 1, wherein the bonding layer is applied to the projectile body surface by spraying.

9. The method of claim 8, wherein the fine solid particles are particles selected from the group consisting of powdered molybdenum, nickel aluminide and cermets based on aluminum nickel oxide particles.

10. The method of claim 1, wherein the fine metal particles sprayed onto the projectile body to form the guide band are an alloy powder.

11. The method of claim 10, wherein the alloy is of the CuZn85/15 type.

12. The method of claim 1, further comprising heating the projectile body prior to the spraying step to a temperature above room temperature and below the temperature at which the particles are sprayed.

13. The method of claim 1, further comprising placing a template onto the projectile body for limiting the width of the sprayed-on guide band.

14. The method of claim 1, further comprising rotatingly guiding the projectile body below a stationary spray device during the spraying step for a continuous and uniform application of the guide band.

15. The method of claim 1, further comprising rotatingly guiding a spray device around the stationary projectile body during the spraying step for a continuous and uniform application of the guide band.

16. The method of claim 1, further comprising subjecting the guide band to machining.

17. The method of claim 1, further comprising internally cooling the projectile body during spraying.

18. The method of claim 1, wherein the heating and spraying steps are conducted in an atmosphere of inert gas.

19. The method of claim 18, wherein the inert gas is selected from the group consisting of argon and nitrogen.

20. A projectile body having a circumferential guide band produced by a method comprising the following steps:

(a) roughening a circumferential ungrooved surface portion of the projectile body by blasting said surface portion with a fine-grained material of greater hardness than the material of the projectile body;

(b) subsequent to the roughening step, applying a bonding layer of preheated fine solid particles to the ungrooved roughened surface portion;

(c) heating fine metal particles at a temperature effective to obtain solely a surface plastification of the fine metal particles; and (d) subsequent to the step of applying the bonding layer, spraying the heated fine metal particles onto said bonding layer to form said guide band, bonded to said projectile body by said bonding layer.

21. The projectile body of claim 20, wherein the guide band has a porosity of no more than 5 volume %.

22. The projectile body of claim 20, wherein the projectile body has a wall thickness between about 2 mm and 4 mm, and a deformed zone of a maximum thickness of about 0.1 mm in the region of contact between the guide band and the projectile surface.

* * * * *

UNITED STATES PATENT AND TRADEMARK OFFICE

CERTIFICATE OF CORRECTION

PATENT NO. : 4,797,985

DATED : January 17, 1989

INVENTOR(S) : Jürgen Prochnow et al

It is certified that error appears in the above-identified patent and that said Letters Patent is hereby corrected as shown below:

In the heading of the patent, under [30] the priority application number should read --3539310--.

Signed and Sealed this

Thirteenth Day of June, 1989

*Attest:*

DONALD J. QUIGG

*Attesting Officer*

*Commissioner of Patents and Trademarks*